United States Patent [19]

L'Heureux

[11] 4,191,001

[45] Mar. 4, 1980

[54] PROCESS FOR REINSULATING CONCRETE BLOCK HOMES

[76] Inventor: Gerard L'Heureux, 1506 Dixie Hwy., Holiday, Fla. 33590

[21] Appl. No.: 911,751

[22] Filed: Jun. 1, 1978

[51] Int. Cl.[2] ..... E04B 1/62

[52] U.S. Cl. ..... 52/743

[58] Field of Search ..... 52/351, 743, 741, 744, 52/416, 417, 515, 516

[56] References Cited

U.S. PATENT DOCUMENTS

| | | | |
|---|---|---|---|
| 1,400,709 | 12/1921 | Worthington | 52/351 |
| 1,461,590 | 7/1923 | Walper | 52/417 |
| 1,969,879 | 8/1934 | Eichner | 52/351 |
| 2,049,907 | 8/1936 | Hess | 52/351 |
| 2,181,530 | 11/1939 | Davenport | 52/417 |
| 2,643,539 | 6/1953 | Bouch | 52/351 |
| 3,353,322 | 11/1967 | Guddal | 52/744 |
| 3,854,985 | 12/1974 | Suzuki et al. | 52/515 |
| 3,971,184 | 7/1976 | Wagoner | 52/515 |

FOREIGN PATENT DOCUMENTS

| | | | |
|---|---|---|---|
| 686254 | 5/1964 | Canada | 52/254 |

*Primary Examiner*—James L. Ridgill, Jr.

*Attorney, Agent, or Firm*—Lerner, David, Littenberg & Samuel

[57] ABSTRACT

A method of reinsulating concrete block homes is provided in which the exterior of the cement block structure is first furred out vertically, high density polystyrene board is then applied horizontally, the butting edges of styrene board being glued, all outside and inside corners are reinforced with lath and otherwise capped, chicken wire or other support is fastened over the styrene board, and then a polymerically bonded concrete mixture is applied to the exterior surface to bond the polymerically bonded concrete mixture to the childen wire and the exterior of the styrene board to form a strong attractive shell with a thermal barrier capable of substantially saving on heat loss of the home.

10 Claims, 7 Drawing Figures

PROCESS FOR REINSULATING CONCRETE BLOCK HOMES

BACKGROUND OF THE INVENTION

In the south of the United States and other parts of the country, many homes were built at a time when the energy crisis was not as publicized as it is today. With the energy crisis, there has come a need to save fuel in all places, even in the warmer climates which do pass through periods of cold. However, it is difficult, using present techniques, to reinsulate a cement block home.

SUMMARY OF THE INVENTION

The present invention allows an existing concrete block building to be reinsulated at a relatively low and affordable price. Through the present invention, the entire reinsulation process is done on the exterior of the house, eliminating extensive remodeling as would be required if the structure were to be retrofitted from within the house. The resultant structure is a low maintenance exterior surface that can be individually custom designed and finished. The finished product may be left in its natural color, painted, or have a glitter (crushed glass) added for a sparkle finish.

The reinsulation is accomplished by:

(a) All exterior mounted devices, i.e., lamps, shutters, etc. are removed to be replaced at the conclusion of the process;

(b) The exterior cement block structures are first furred out. Using 1"×2" pressure treated lumber applied vertically with an air operated mechanical nail gunner fastener, the furring strips are installed 16" apart with the 2" side of the stripping directed against the outside wall. The areas where the exterior mounted devices had been removed need to be individually furred out for later replacement purposes.

(c) Once the side of the structure has been completely furred out, a high density polystyrene board (in a preferred embodiment Dylite M-70) 4'×12'×1" is applied horizontally, after being cut by hand to mold to the contour of the building. The beginning and ending of each styrene board is again mechanically fastened with 1½" washer-head nails not less than 12" apart to the fur stripping. All butting joints of the polystyrene board material are to be glued, using a polystyrene glue such as Ultra Bond 500 Fosta Foam, with a continuous bead, a minimum of ¼" wide. This seals the abutting boards to achieve continuous moisture barrier, and makes the exterior surface completely waterproof. It should further be understood that the thickness of the polystyrene board will vary in accordance with the desired R-factor.

(d) All outside corners are reinforced with metal lath secured to the styrene board and mechanically fastened with 1½" washer-head nails. Inside corners are also reinforced with metal lath and secured by the washer-head nails for extra strength. Where the top board abuts a gable coverage, an "L" channel will cap off board and slide under the gable cover.

(e) Chicken wire or other mechanical support means is secured over the styrene board by wire staples or other fastening means.

(f) Finally, a polymeric concrete bonding mixture is provided. This mixture in the preferred embodiment is 49.7# of white Portland Cement, 49.6# of a polymeric bonding agent, 35 shovels of white masonry sand, approximately 10 gallons of water and 1 gallon of an acrylic emulsion. The combined ingredients are agitated to a proper working consistency and then applied with a trowel directly over the chicken wire and styrene boards in at least ¼" minimum thickness. The seams are reinforced with 2" wide fiberglass 20/20 mesh stripping. After the mixture has set, an additional lace coating (⅛" thick) is applied. The texture of the surface of the polymerically bonded concrete can be designed to suit the customer's requirements. If a glitter surface is required, crushed glass is sprinkled on the surface before it is completely dried The resultant structure is operative to insulate the home and to keep out moisture. Between the old exterior of the concrete block building and the waterproof styrene board is a 1" dead air space. The polystyrene board seals out moisture and the polymerically bonded concrete or stucco finish completely refurbishes the exterior surface. The chicken wire gives mechanical structural strength to the stucco finish. The finish is adobe white or may be painted later. The actual finish can vary in the same way that ordinary stucco finishes can be varied even to include a brick-type surface.

The R-factor of a complete reinsulation in accordance with the present invention utilizing ⅜" of stucco, 1" of styrofoam board, 2 furring strips per cement block, and the included air space was found to be 10.45. The R-factor for the complete system including the standard 8"×16" cement block was found to be 11.79. The heat saving of the complete system as compared with bare cement block was found to be 62.8%.

DETAILED DESCRIPTION OF THE DRAWINGS

Figure 1:
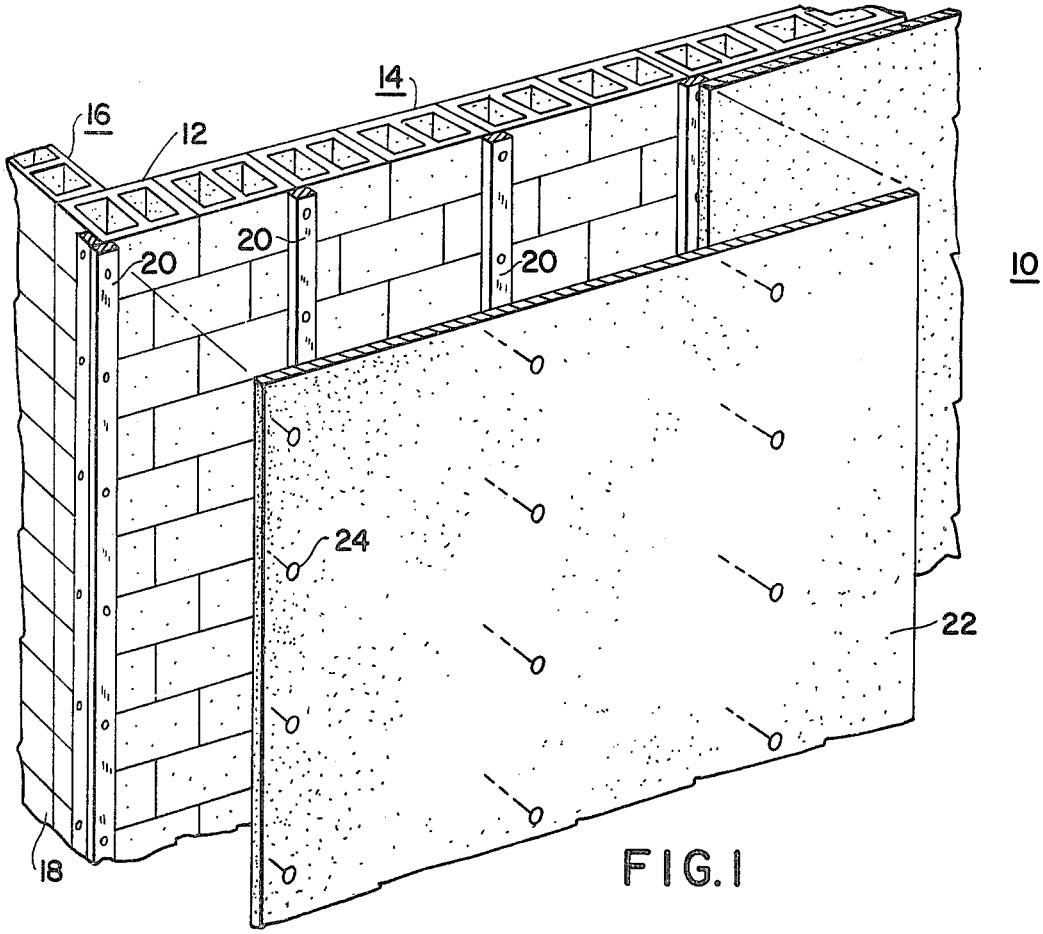
FIG. 1 is an exploded view of the first steps in reinsulating a concrete block building in accordance with the teachings of the present invention.
Figure 2:
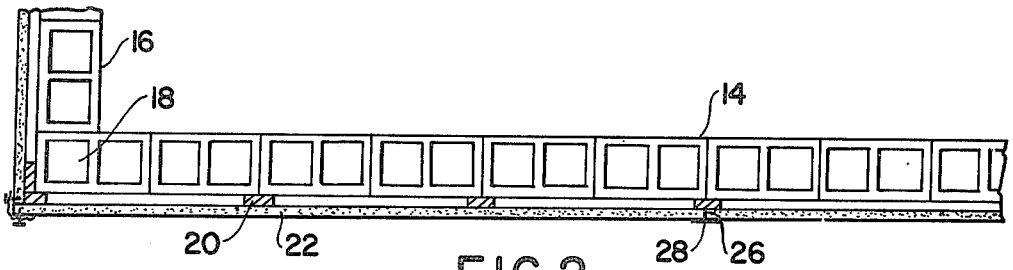
FIG. 2 is a cross-sectional view of the corner of a building shown in FIG. 1 after the styrofoam board is applied.

In FIG. 1 there is shown a system for reinsulating an existing concrete block structure. The system is generally designated by the numeral 10. The existing concrete block wall structure consists of concrete blocks 12. The concrete blocks 12 are formed into a wall 14 and a wall 16 joined at a corner 18. 1"×2" furring strips 20 are placed on 16" centers vertically along the width of the wall. The furring strips are preferably made of pressure-treated lumber and are mechanically fastened to the wall with an air operated mechanical "T" nail gun or fastener. The fur strips 20 are installed 16" apart (off-center) with the 2" side of the stripping directed against the outside wall. Prior to the placing of the furring strips 20 on the wall, all exterior mounted devices such as lamps, shutters, etc., are removed to be replaced at the conclusion of the process.

If the removed device areas need to be individually furred out before replacement, this is also accomplished at this time.

Once the sides 14 and 16 have been completely furred out, a high density polystyrene board 4'×12'×1" is applied horizontally after being cut by hand to mold to the contour of the building. Dylite M-70 High Density Polystyrene Board has been found to be effective for this purpose. Obviously, different thicknesses of polystyrene board can be used in accordance with the desired R-factor to be achieved.

The beginning and ending of each polystyrene board 22 is on the center of the fur strips 20. The sytrene board is mechanically fastened with 1½" washer-head nails 24 not less than 12" apart on the fur stripping.

Figure 4:
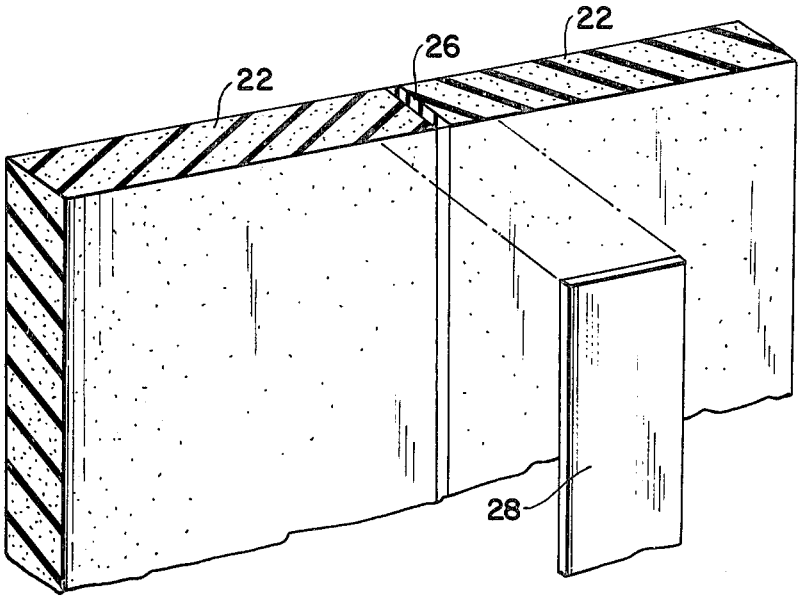
FIG. 4 is an exploded view of the abutting joints of two polystyrene boards utilized in accordance with the teachings of the present invention.

All butting joints of the polystyrene board material 22 is to be glued using a polymeric bonding material such as Ultra Bond 500 Fosta Foam with a continuous bead 26 a minimum of 174" wide. This is best shown in FIG. 4. The glue bead 26 seals the abutting boards to achieve continuous moisture barrier. Further, a fiberglass stripping 28 is glued in place over the joint to complete the seal.

Figure 3:
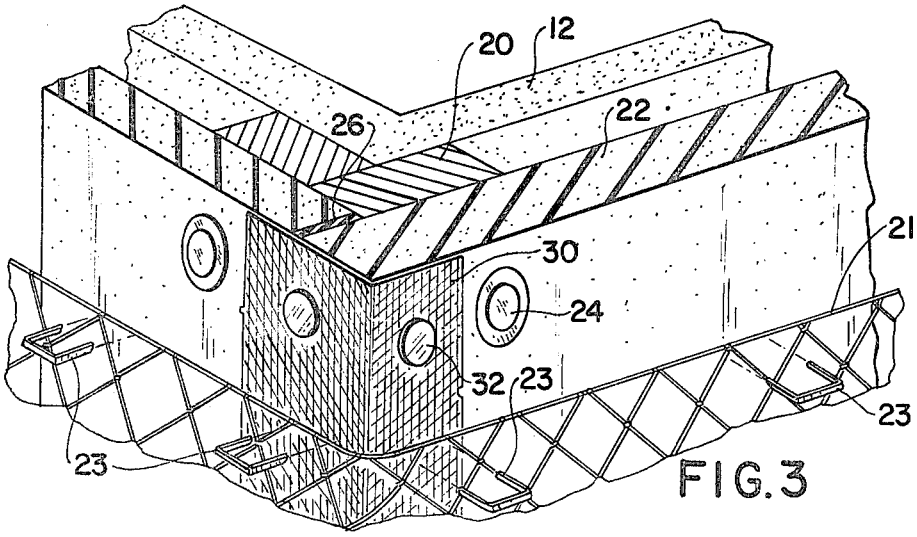
FIG. 3 is a cross-sectional view of one corner of the building shown in FIG. 1.
Figure 5:
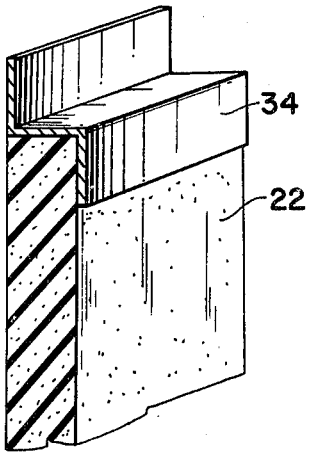
FIG. 5 shows the manner in which the top edge of a board is capped at a gable.

All outside corners are reinforced with metal lath as at 30 in FIG. 3 secured to the styrene board with 1½" washer-head nails 32 mechanically fastening the lathing 30 to the board 22 at the corners. Inside corners are also reinforced with metal lath and secured by washer-head nails for extra strength. Where the top of a board abuts a gable coverage, an "L" channel as at 34 in FIG. 5 will cap off the board and slide under the gable cover.

Chicken wire 21 or other mechanical reinforcing means is then fastened, as by staples 23, to the styrene boards 22 and into furring strip 20.

Next, a polymerically bonded concrete mixture is provided. One example which has been used for this purpose is as follows:

(a) 49.7# of white Portland Cement;
(b) 49.6# of polymerically bonded material sold under the brand name Bond Crete;
(c) 35 shovels of white masonry sand;
(d) Approximately 10 gallons of water; and
(e) 1 gallon of an acrylic emulsion.

Figure 6:
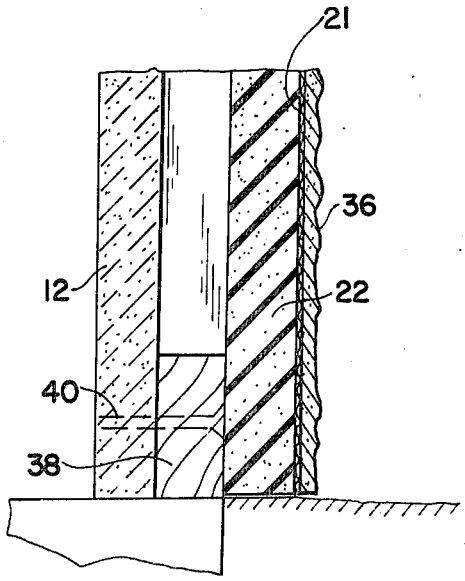
FIG. 6 is a cross-sectional view of a wall reinsulated in accordance with the teachings of the present invention at the base thereof.
Figure 7:
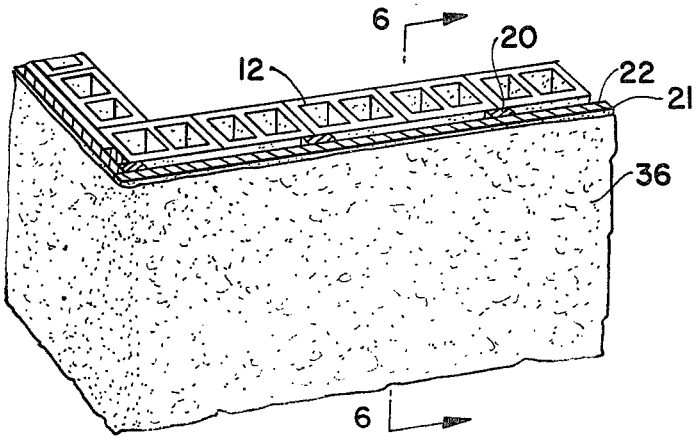
FIG. 7 shows the completed surface of the wall shown in FIG. 6.

The above ingredients are combined in a two-bag agitator to achieve proper working consistency. The resultant mixture is then applied with a trowel directly over the chicken wire 21 and polystyrene board 22 in ¼" minimum thickness with the seams, as previously noted, reinforced with the 2" wide fiberglass 20/20 mesh stripping 28. This is best shown in FIGS. 6 and 7 wherein the polymerically bonded concrete coating has been noted by the numeral 36. As noted in FIG. 6, at the base of the structure, horizontal studs 38 are secured by nails 40 to the cinder blocks 12. After the surface 36 has set, an additional lace coating ⅛" thick is applied. The texture of the coating 36 can be made to suit a customer's convenience. For example, if glitter is desired, crushed glass can be sprinkled on the surface before it is completely dried.

It can thus be seen that the resultant home reinsulated by the above process has had substantial thermo-insulation added with little disruption of the home. Tests on structures which have been reinsulated in accordance with the present invention were made according to A.S.T.M. Designation C-236-66 entitled "Thermal Conductance and Transmittance of Built-up Sections By Means of the Guarded Hot Box" and the following determinations were achieved:

(1) The R-factor of the insulation including ⅜" of stucco, 1" of polystyrene board, 2 furring strips per cement block and the included air space was found to be 10.45.
(2) The R-factor for the complete system, including the standard 8"×16" cement block was found to be 11.79.
(3) The heat saving of the entire system as compared with bare cement block was found to be 62.8%.

These results indicate the substantial energy-saving qualities of the present invention. All of this has been achieved while beautifying the home and is accomplished in a simple manner without substantial expense.

The alternative methods of foam-in-place insulation do not work for concrete block homes and could not achieve the kind of results achieved with the herein invention. There is no disruption to the interior of the building which is a substantial advantage and no loss of interior wall space or danger of break-up of the wall while the insulation process is being accomplished.

Although this invention has been described with respect to its preferred embodiments, it should be understood that many variations and modifications will now be obvious to those skilled in the art, and it is preferred, therefore, that the scope of the invention be limited, not by the specific disclosure herein but only by the appended claims.

I claim as my invention:

1. A process of insulating a concrete block building comprising the steps of fastening furring strips at spaced parallel positions along the exterior surface of the building; affixing rigid thermal insulating panels to said furring strips about the exterior surface of said wall to provide a moisture-proof wall structure with a dead air space between the panels and the existing concrete block wall; fastening a mechanical reinforcing metal mesh to cover substantially the entire surface of said rigid thermal insulating panels; and forming a concrete surface on said reinforcing metal mesh about the exterior surface of said panels to complete the insulation of the building.

2. The process of claim 1 further including the step of applying a reinforcing metal lath to the inside and outside corners of said building after said rigid thermal insulating panels are affixed.

3. The process of insulating a concrete block building of claim 1 including the steps of first removing all exterior mounted devices from the concrete block building and as a final step replacing said exterior mounted devices.

4. The process of insulating a concrete block building of claim 1 wherein the step of forming a concrete surface includes covering all joints and corners of the panels before applying the concrete surface finish.

5. The process of insulating a building of claim 1 wherein said step of fastening includes fastening said furring strips vertically in spaced parallel relationship.

6. The process of insulating a concrete block building of claim 5 wherein the step of affixing thermal insulating panels includes providing panels whose length is greater than its width and mechanically affixing said boards horizontally to said furring strips.

7. The process of insulating a concrete block building of claim 1 wherein said panels are formed of polystyrene.

8. The process of insulating a concrete block building of claim 1 wherein the step of forming a concrete surface includes providing a polymerically bonded concrete finish.

9. The process of insulating a concrete block building of claim 7 wherein said panels are formed of a polystyrene.

10. The process of insulating a concrete block building of claims 6 or 8 wherein said polystyrene panels are glued together by a bead of glue along their abutting edges.

* * * * *

UNITED STATES PATENT AND TRADEMARK OFFICE

CERTIFICATE OF CORRECTION

PATENT NO. : 4,191,001

DATED : March 4, 1980

INVENTOR(S) : Gerard L'Heureux

It is certified that error appears in the above-identified patent and that said Letters Patent are hereby corrected as shown below:

Column 1, line 44, after the word "board" insert: -- is on center of the furring strip. The styrene board -- .

Column 3, line 22, delete "174" and insert therefor: -- 1/4 -- .

Signed and Sealed this

Eighth Day of July 1980

[SEAL]

Attest:

SIDNEY A. DIAMOND

Attesting Officer

Commissioner of Patents and Trademarks